US005608368A

United States Patent [19]

Ricco et al.

[11] Patent Number: 5,608,368

[45] Date of Patent: Mar. 4, 1997

[54] ELECTROMAGNET FOR CONTROLLING THE METERING VALVE OF A FUEL INJECTOR

[75] Inventors: Mario Ricco; Giovanni Bruni, both of Bari, Italy

[73] Assignee: Elasis Sistema Ricerca Fiat Nel Mezzogiorno Societa Consortile per Azioni, Pomigliano D'Arco, Italy

[21] Appl. No.: 365,587

[22] Filed: Dec. 28, 1994

[30] Foreign Application Priority Data

Dec. 30, 1993 [IT] Italy ..... TO93A1020

[51] Int. Cl.[6] ..... H01F 3/00

[52] U.S. Cl. ..... 335/281; 335/279; 251/129.01; 419/45

[58] Field of Search ..... 335/279, 280, 335/281, 282; 251/129.01, 129.07, 129.09, 129.16; 419/45, 56

[56] References Cited

U.S. PATENT DOCUMENTS 4,232,283 11/1980 Werst ..... 313/212
5,160,447 11/1992 Ishikawa .
5,534,220 7/1996 Purnell et al. ..... 419/45

FOREIGN PATENT DOCUMENTS 0483769 10/1991 European Pat. Off. .
2545640 3/1984 France .

OTHER PUBLICATIONS

Patent Abstracts of Japan, vol. 16, No. 420 (E 1259) Sep. 4, 1992).

*Primary Examiner*—Lincoln Donovan
*Attorney, Agent, or Firm*—Ladas & Parry

[57] ABSTRACT

The metering valve is controlled by an electromagnet having a fixed core, a coil, and an armature. The core is formed by pressing and subsequently sintering a mixture of powdered ferrous material and an epoxy binder; and presents a low magnetic hysteresis and low parasitic currents, so that, for a given energizing current, a greater magnetic force is achieved and more rapidly, and, for a given magnetic force or maximum operating frequency, the core and/or coil may be made smaller.

9 Claims, 2 Drawing Sheets

ELECTROMAGNET FOR CONTROLLING THE METERING VALVE OF A FUEL INJECTOR

BACKGROUND OF THE INVENTION

The present invention relates to an electromagnet for controlling the metering valve of a fuel injector, comprising a fixed core of magnetizable material, an electric energizing coil, and an armature for activating the valve.

The metering valves of fuel injectors normally comprise a control chamber having a drain conduit which, by means of a shutter, is normally closed by the armature of the electromagnet, and is opened by energizing the electromagnet and so moving the armature towards the core.

As is known, the main parameter for evaluating the efficiency of a metering valve is the maximum permissible operating frequency, which depends on the speed with which the valve responds to a command to open or close the drain conduit, and hence on the speed with which it responds to energizing or de-energizing of the electromagnet.

In known metering valves, the fixed core of the electromagnet is made of magnetizable ferrous material, usually ferrite, which, despite good magnetic permeability, presents a considerable hysteresis loop, and is subject to severe parasitic currents, which seriously impair the magnetic force of the core.

Known cores therefore take a relatively long time to reach the necessary magnetic force, thus limiting both the response of the electromagnet and maximum operating frequency. As a result, to speed up response, the core and coil must be oversized, thus greatly increasing both production and operating cost.

SUMMARY OF THE INVENTION

It is an object of the present invention to provide a highly straightforward, reliable metering valve electromagnet of the aforementioned type, designed to overcome the aforementioned drawbacks typically associated with known electromagnets.

According to the present invention, there is provided an electromagnet for controlling the metering valve of a fuel injector, comprising a fixed core of magnetizable material; an electric energizing coil; and an armature for activating said valve; characterized in that said core is formed by pressing a mixture of powdered ferrous material and an epoxy binder; said core so formed then being sintered

BRIEF DESCRIPTION OF THE DRAWINGS

A preferred, non-limiting embodiment of the present invention will be described by way of example with reference to the accompanying drawings, in which.

DETAILED DESCRIPTION OF TEE INVENTION

Figure 1:
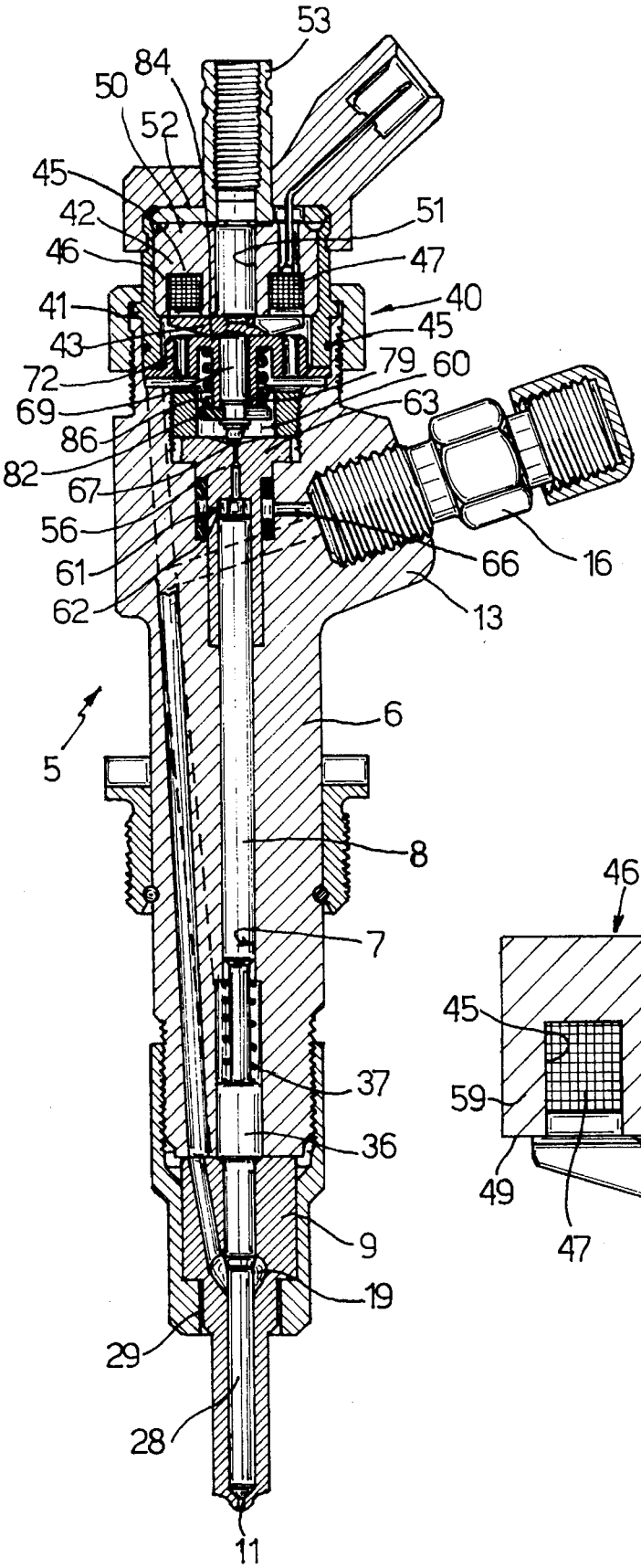
FIG. 1 shows a half section of a fuel injector featuring an electromagnet for controlling the metering valve in accordance with the present invention.

Number 5 in FIG. 1 indicates a fuel injector, e.g. for a diesel internal combustion engine.

Injector 5 comprises a hollow body 6 having an axial cavity 7 in which slides a control rod 8. At the bottom, body 6 is connected to a nozzle 9 terminating with an injection orifice 11 normally closed by the tip of a pin 28 connected to rod 8.

Body 6 also presents a hollow appendix 13 housing an inlet fitting 16 connected to a normal high-pressure, e.g. 1200 bar, fuel supply pump. The fuel is fed along internal conduits to an injection chamber 19; and pin 28 presents a shoulder 29 on which the pressurized fuel in chamber 19 acts. A compression spring 37 contributes towards pushing rod 8 and pin 28 downwards.

Injector 5 also comprises a metering valve 40 in turn comprising a fixed sleeve 41 for supporting an electromagnet 42 controlling a disk-shaped armature 43 of ferromagnetic material. Electromagnet 42 comprises a fixed core 46 of ferromagnetic material, and presents an annular seat 45 housing a normal electric activating 47. Sleeve 41 also connects a disk 52 in one piece with a drain fitting 53 aligned with an axial hole 51 in core 46 and connected to the fuel tank.

Figure 2:
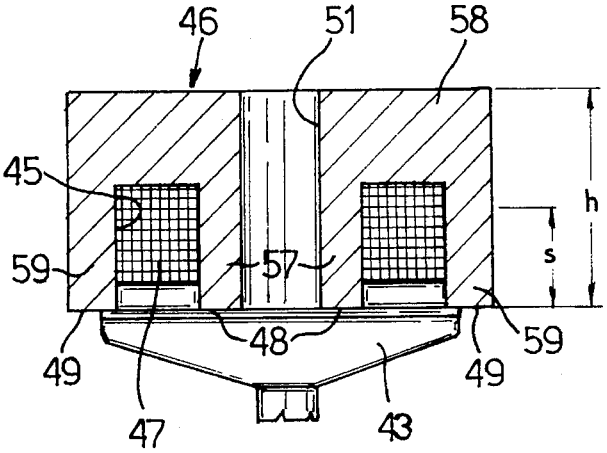
FIG. 2 Shows a larger-scale section of a detail in FIG. 1.

Core 46 (FIG. 2) comprises a cylindrical inner sleeve 57 with hole 51; an outer sleeve 59 coaxial with sleeve 57; and a disk portion 58 connecting sleeves 57 and 59, which present respective annular pole surfaces 48 and 49 coplanar and coaxial with each other and with which armature 43 cooperates.

Metering valve 40 also comprises a head 56 (FIG. 1) housed inside a seat in body 6, coaxial with cavity 7, and which defines downwards a drain chamber 60, extending axially in the body 6, from the upper surface of head 56 to the lower surface 48, 49 of core 46.

Head 56 also presents an axial control chamber 61 communicating with a calibrated radial inlet conduit 62, and with a calibrated axial drain conduit 63. Inlet conduit 62 communicates with conduit 16 via a radial conduit 66 in body 6; and control chamber 61 is defined at the bottom by the upper surface of rod 8.

By virtue of the larger area of the upper surface of rod 8 as compared with that of shoulder 29, the pressure of the fuel, together with spring 37, normally keeps rod 8 and pin 28 in such a position as to close orifice 11 of nozzle 9. Drain conduit 63 of control chamber 61 is normally closed by a shutter comprising a ball 67 on which stem 69 of armature 43 acts; and drain chamber 60 communicates with axial hole 51 in core 46 and consequently with drain fitting 53.

Stem 69 of armature 43 presents a flange 82 supporting an armature return spring 86 housed in a seat 84 in a plate member 72 fitted adjustably to body 6. The travel of armature 43 towards pole surfaces 48, 49 of core 46 is defined by the end of a sleeve 79 forming one piece with plate member 72, so as to prevent armature 43 from contacting core 46.

Electromagnet 42 is normally de-energized, so that armature 43 is held by return spring 86 in the down position in FIG. 1; stem 69 keeps ball 67 in the position closing drain conduit 63; control chamber 61 is pressurized and, together with the action of spring 37, overcomes the pressure on shoulder 29 so that rod 8 is held down together with pin 28 which closes orifice 11.

When electromagnet 42 is energized, armature 43 is raised and stem 69 releases ball 67; the fuel pressure in chamber 61 falls so as to open metering valve 40 and discharge the fuel into drain chamber 60 and back into the tank; the fuel pressure in injection chamber 19 now overcomes the force exerted by spring 37, and so raises pin 28 to open orifice 11 and inject the fuel in chamber 19.

When electromagnet 42 is de-energized, armature 43, by virtue of the gap remaining in relation to core 46, is restored rapidly to the down position by spring 86; armature 43 restores ball 67 to the position closing drain conduit 63; the pressurized incoming fuel from conduit 62 restores the pressure inside control chamber 61; and pin 28 moves back down to close orifice 11.

According to the present invention, fixed core 46 of electromagnet 42 is formed by pressing a mixture of powdered ferrous material and an epoxy binder inside molds, and subsequently sintering the pressed core in an Oven.

The ferrous material preferably consists of ferrite; and the epoxy binder may be selected from a number of epoxy resins, and mixed with the ferrite powder in the amount of 2–50% by weight of the mixture. Core 46 is preferably formed using an epoxy resin and ferrite mixture containing 3% resin.

By virtue of the above characteristics of the mixture, core 46 may advantageously be designed to achieve the required performance with a reduction in size as compared with ferrite cores. More specifically, for an operating frequency of at least 50 Hz, it is possible not only to reduce the diameter of core 46 and the thickness of sleeves 57 and 59 (FIG. 2), but also to increase the size of seat 45 of coil 47.

Preferably, the radius of coil 47 may be increased to 40% of that of armature 43; and the axial dimension "s" of seat 45 of coil 47 may be increased to 60% of axial dimension "h" of core 46, so that the thickness of portion 58 is less than dimension "s".

Providing a minimum gap of 0.05 mm for armature 3, coil 47 may present from 16 to 40 turns, and be energized with a voltage of 12 V for 80 to 350 μsec. Tests using such an electromagnet 42 have shown core 46, formed from the selected mixture, to present low magnetic hysteresis and low parasitic currents.

Figure 3:
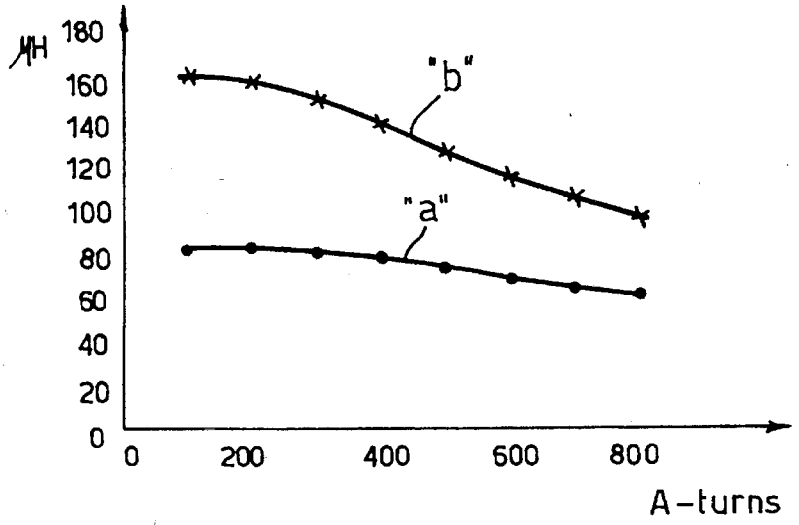
FIG. 3 shows a graph of a characteristic of the electromagnet.

Moreover, the magnetic inductance of core 46 is relatively lower as compared with conventional ferrite cores. The graph in FIG. 3 shows a curve "a" indicating the inductance of core 46, expressed in micro-Henry (μH), in relation to the current of coil 47, expressed in ampere-turns (A-turns); and a curve "b" indicating the corresponding, and much higher, inductance of a conventional core.

As shown in curve "a", the inductance of core 46 varies only slightly alongside a variation in the energizing current of coil 47, and may therefore be said to remain substantially constant up to currents of 800 A-turns. More specifically, magnetic inductance "a" varies between 80 and 60 μH alongside a variation in energizing current from 100 to 800 A-turns.

Figure 4:
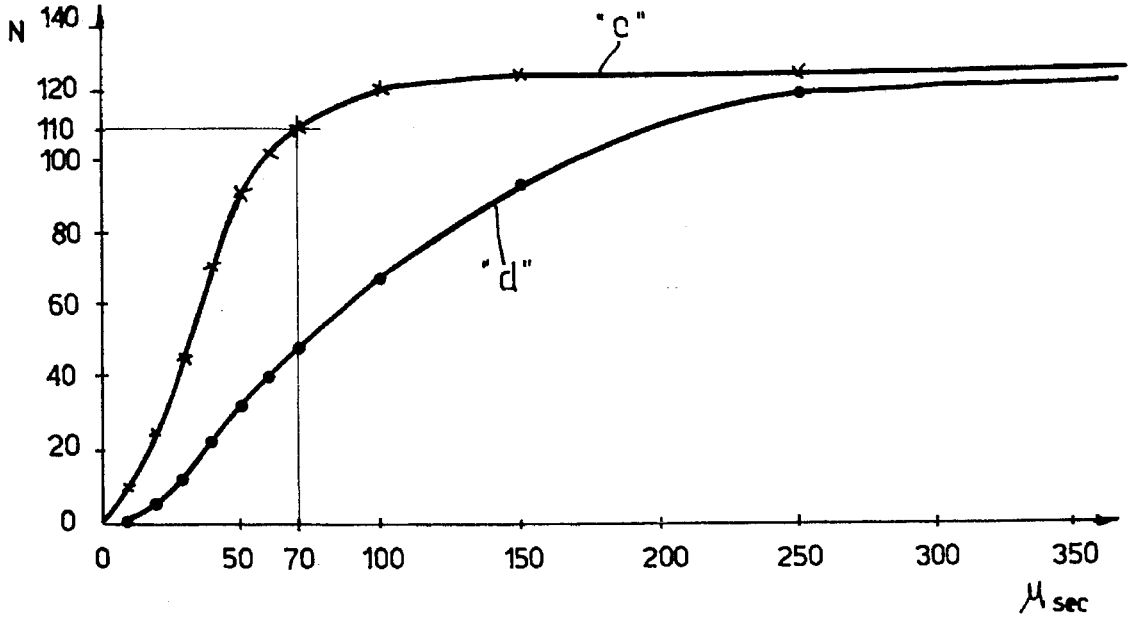
FIG. 4 shows a graph of a further characteristic of the electromagnet.

The FIG. 4 graph shows a curve "c" indicating the magnetic force, expressed in Newtons (N), exerted by core 46 when coil 47 is subjected to a given current, e.g. 800 A-turns, and as a function of the excitation time of coil 47, expressed in μsec; and a curve "d" indicating the corresponding magnetic force of a conventional core, which is considerably lower, especially in the first 250 μsec range.

As shown in curve "c", the magnetic force of core 46 presents an asymptote at a value of about 135 N, and reaches a value of about 110 N in roughly 70 μsec, i.e. reaches 90% of its asymptotic value in less than 80 μsec.

The advantages of the electromagnet according to the present invention are as follows. Firstly, by virtue of drastically reducing hysteresis and magnetic losses due to parasitic currents, the present invention provides for achieving much greater magnetic force for a given energizing current, and more rapidly. Secondly, reducing the parasitic currents provides for achieving high excitation gradients and, hence, high operating frequencies. And thirdly, the inductance characteristic of the core material enables a reduction in the size of the electromagnet, by enabling a reduction in the size of core 46 and coil 47 for a given magnetic force.

Clearly, changes may be made to the electromagnet as described and illustrated herein without, however, departing from the scope of the claims. For example, it may be applied to an injector differing from the one described herein; and the magnetic circuit of core 46 may be of any design, e.g. two coaxial, prismatic-section sleeves, or two or more parallel prismatic portions.

We claim:

1. An electromagnet for controlling the metering valve of a fuel injector, comprising a fixed core (46) of magnetizable material; an electric energizing coil (47); and an armature (43) for activating said valve; characterized in that said core (46) is formed by pressing a mixture of powdered ferrous material and an epoxy binder; said core so formed then being sintered.

2. An electromagnet as claimed in claim 1, characterized in that said ferrous material consists of ferrite; and said epoxy binder is selected from a number of epoxy resins.

3. An electromagnet as claimed in claim 2, characterized in that said mixture contains from 2% to 50% by weight of said epoxy resin.

4. An electromagnet as claimed in claim 1, characterized in that said mixture is such that said core (46) presents a low magnetic hysteresis and low parasitic currents.

5. An electromagnet as claimed in claim 4, characterized in that said core (46) presents a substantially constant magnetic inductance alongside variations in the energizing current of said coil (47).

6. An electromagnet as claimed in claim 5, characterized in that said magnetic inductance varies between 80 and 60 μH alongside a variation in said current between 100 and 800 A-turns.

7. An electromagnet as claimed in claim 4, characterized in that the magnetic force of said core (46) reaches 90% of its asymptotic value within less than 80 μsec.

8. An electromagnet as claimed in claim 7, characterized in that said coil presents from 16 to 40 turns, and is energized with a voltage of 12 V for 80 to 350 μsec.

9. An electromagnet as claimed in claim 1, wherein said armature (43) is disk-shaped, and said core (46) presents an annular seat (45) for housing said coil (47); said core (46) being formed by an inner sleeve (57) , an outer sleeve (59), and a disk portion (58) connecting said sleeves (57, 59); and said sleeves (57, 59) forming two pole surfaces (48, 49) cooperating with said armature (43); characterized by the fact that said annular seat (45) presents a radial dimension of about 40% of the radius of said armature, and an axial dimension (s) of about 60% of the axial dimension of said core (46); the minimum gap between said armature (43) and said surfaces (48, 49) being about 0.05 mm.

* * * * *